US008763634B2

(12) United States Patent
Akaishi et al.

(10) Patent No.: US 8,763,634 B2
(45) Date of Patent: Jul. 1, 2014

(54) RELIEF DEVICE FOR OIL PUMP

(75) Inventors: Nobuyuki Akaishi, Saitama (JP); Masataka Ikawa, Saitama (JP); Yasuhiro Ueta, Saitama (JP); Takuji Ishioka, Saitama (JP); Hidehiko Kamiyama, Tochigi (JP); Takuya Yamazaki, Tochigi (JP); Yoshiro Umezawa, Gunma (JP); Hirokazu Inoue, Gunma (JP); Yoshitaka Kurokawa, Gunma (JP)

(73) Assignees: Honda Motor Co., Ltd., Tokyo (JP); Yamada Manufacturing Co., Ltd., Kiryu-Shi, Gunma-Ken (JP)

( * ) Notice: Subject to any disclaimer, the term of this patent is extended or adjusted under 35 U.S.C. 154(b) by 169 days.

(21) Appl. No.: 13/545,899

(22) Filed: Jul. 10, 2012

(65) Prior Publication Data

US 2013/0014838 A1 Jan. 17, 2013

(30) Foreign Application Priority Data

Jul. 12, 2011 (JP) ..... 2011-154357

(51) Int. Cl.
*F16K 17/00* (2006.01)

(52) U.S. Cl.
USPC ..... 137/516.27; 137/540; 137/512.5; 417/307

(58) Field of Classification Search
CPC ..... F16K 15/025; F04B 49/03; F04B 49/035
USPC ..... 137/512.3, 512.5, 538, 540, 516.27; 417/307, 310
See application file for complete search history.

(56) References Cited

U.S. PATENT DOCUMENTS

| | | | | |
|---|---|---|---|---|
| 2,011,333 | A * | 8/1935 | Clifton | 137/538 |
| 6,004,111 | A | 12/1999 | Miyazaki et al. | |
| 6,247,904 | B1 | 6/2001 | Miyazaki et al. | |
| 6,352,085 | B1 * | 3/2002 | Morita et al. | 137/516.27 |
| 6,481,458 | B2 * | 11/2002 | Hirano et al. | 137/538 |
| 8,297,307 | B2 * | 10/2012 | Kurokawa et al. | 137/538 |

FOREIGN PATENT DOCUMENTS

JP 10-318158 A 12/1998

* cited by examiner

*Primary Examiner* — John Rivell
*Assistant Examiner* — R. K. Arundale
(74) *Attorney, Agent, or Firm* — McGinn IP Law Group, PLLC

(57) ABSTRACT

A relief device includes a relief housing constituted by a relief inflow portion, a valve passage portion, a recess, and an oil discharge portion having a relief hole; a relief valve having a small-diameter portion between a first large-diameter portion and a second large-diameter portion; and a spring elastically biasing the relief valve toward the relief inflow portion. The recess is formed at a position that is closer to the relief inflow portion side than to the oil discharge portion, the axial length of the recess is larger than the axial length of the first large-diameter portion of the relief valve, and the shortest axial distance between the recess and the relief hole is less than the axial length of the small-diameter portion.

5 Claims, 10 Drawing Sheets

Fi.g1C

Fig.2A
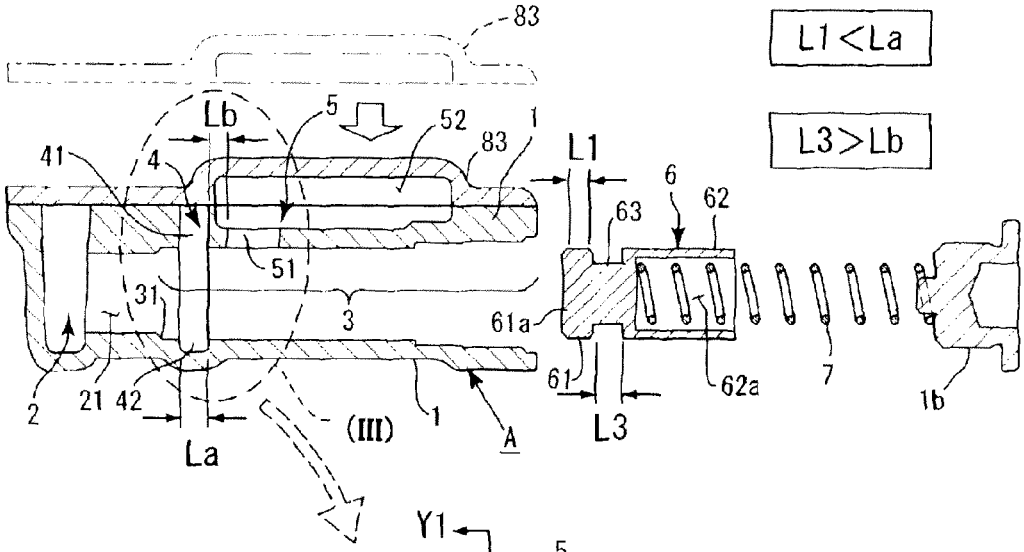
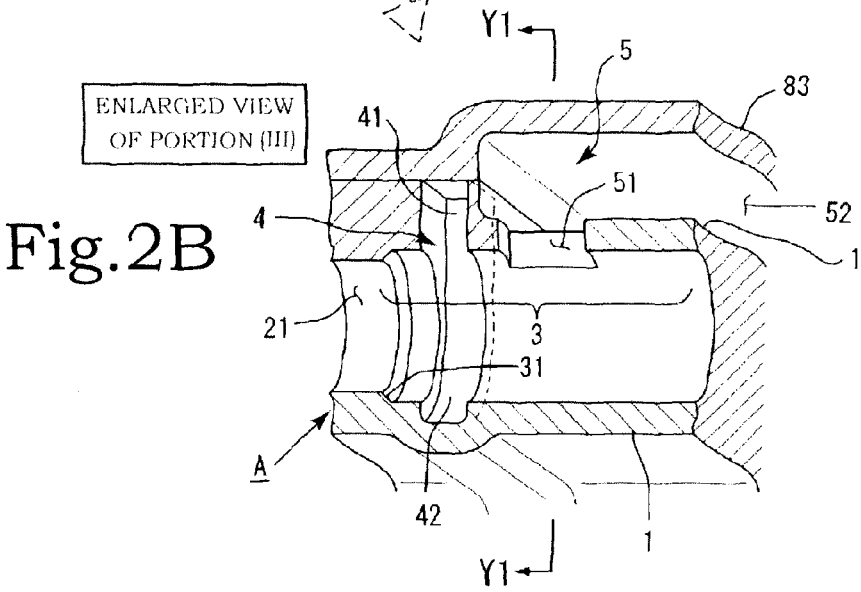
Fig.2B
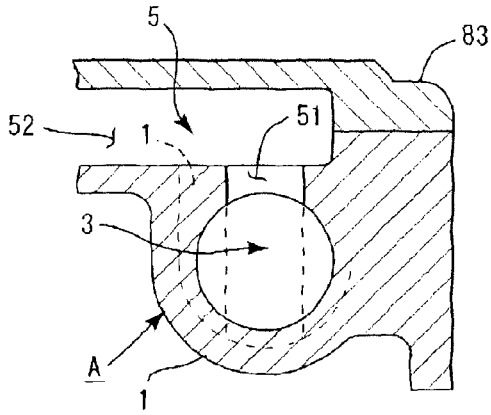
Fig.2C
VIEW ALONG ARROW Y1-Y1

SET STATE

STOP OF RELIEF

STOP OF RELIEF

LOW-REVOLUTION REGION

RELIEF DEVICE FOR OIL PUMP

BACKGROUND OF THE INVENTION

1. Field of the Invention

The present invention relates to a relief device for an oil pump that can ensure an appropriate pressure of oil discharged from the oil pump in a high-revolution region of an engine, ensure good lubrication ability in a medium-revolution region, and improve the efficiency of the engine.

2. Description of the Related Art

A relief valve is often installed, downstream of an oil pump, as a device for preventing an excessive increase in the discharge pressure of the oil pump. The conventional relief valves have a function of protecting the flow channel and devices located thereon from an extremely high oil pressure, but in recent years the emphasis has been placed on reduction of ineffective operations of the oil pump by the adjustment of oil pressure to the intended value in order to reduce fuel consumption.

The relief valves as means for adjusting the discharge pressure of oil pumps in order to realize the abovementioned function have been actively researched and developed. Thus, Japanese Patent Application Publication No. H10-318158 discloses the configuration of a relief valve as means for adjusting the discharge pressure of an oil pump in which ineffective operations of the oil pump are reduced by ensuring the relief (discharge) of oil in a medium-revolution region of the engine.

In Japanese Patent Application Publication No. H10-318158, a control valve 30 is configured by a valve housing 31 having an inner hole 31*a* and also a control port 31*b*, a sub-port 31*c*, and a main port 31*d* that communicate with the inner hole 31*a*; a spool 32 that is installed to be axially slidable in the inner hole 31*a* of the valve housing 31, receives at one end thereof the pressure of work oil flowing in through the control port 31*b*, forms, together with the valve housing 31, variable throttle portions A and B, and performs variable control of connecting and disconnecting the ports 31*b*, 31*c*, and 31*d* by a land portion 32*a*; and a spring 33 that biases the spool 32.

The control port 31*b* communicates with a discharge port 21*e*, the sub-port 31*c* communicates with a sub-intake port 21*d*, and the main port 31*d* communicates with a main intake port 21*c*. The land portion 32*a* of the spool 32 is formed integrally therewith at one end side of the spool 32, and a slope face 32*b* that is inclined from the outer circumferential portion of the land portion 32*a* toward the axial center of the spool 32 is formed at the other end side of the land portion 32*a*. A diametrical step 32*c* is formed between the end portion of the slope face 32*b* on the land portion 32*a* side and the outer circumference of the land portion 32*a*.

Specific features of the control are mainly manifested in the second control mode and third control mode. In the second control mode, the sub-port 31*c* and the control port 31*b* communicate via the variable throttle portion A in a state in which the communication of the sub-port 31*c* and the main port 31*d* is maintained, and the work oil flows from the main port 31*d* and the control port 31*b* into the sub-port 31*c*. In the third control mode, the sub-port 31*c* and the main port 31*d* communicate via the variable throttle portion B in a state in which the communication of the sub-port 31*c* and the control port 31*b* is maintained, and the work oil flows from the control port 31*b* into the sub-port 31*c* and the main port 31*d*.

In order to perform the above-described control, the axial dimension L of the land portion 32*a* is made less than the axial dimension of the sub-port 31*c*. As a result, when the land portion 32*a* is positioned right beside the sub-port 31*c*, gaps appear at both (upper and lower) axial ends of the land portion 32*a* and the work oil can communicate with the flank of the land portion 32*a* (see Japanese Patent Application Publication No. H10-318158, FIGS. 7 and 8).

The following problems are associated with Japanese Patent Application Publication No. H10-318158 in which the abovementioned configuration and control are disclosed. Thus, the high-revolution region of the engine (oil pump 20) corresponds to the fifth control mode and FIG. 10 in Japanese Patent Application Publication No. H10-318158. Thus, in the high-revolution region of the engine, the work oil flows from the control port 31*b* (discharge port 21*e*) into both the sub-port 31*c* (sub-intake port 21*d* ) and the main port 31*d* (main intake port 21*c* ). The resultant problem is that in the high-revolution region of the engine, the oil pressure unexpectedly becomes too low.

In the configuration disclosed in Japanese Patent Application Publication No. H10-318158, when the revolution speed N of a crankshaft 10 is equal to or greater than N1 (characteristic of point (a)), the sub-port 31*c* is open at all times. In other words, from a revolution region slightly higher than the idling revolution region to a maximum (MAX) revolution region, minimum one location is open.

Therefore, since the aforementioned sub-port 31*c* is open at all times in the configuration disclosed in Japanese Patent Application Publication No. H10-318158, it is structurally impossible for the configuration to perform a control, for example, such that temporarily closes the control valve 30 to ensure lubrication in the medium-revolution region of the engine and opens the control valve 30 again to improve the efficiency in the high-revolution region of the engine. It is an object of the present invention (technical problem to be resolved by the present invention) to ensure an appropriate pressure of oil discharged from the oil pump in a high-revolution region of the engine, ensure good lubrication ability in a medium-revolution region, and improve the efficiency of the engine.

The inventors have conducted a comprehensive study aimed at the resolution of the above-described problems and have found that those problems can be resolved by the first aspect of the present invention residing in a relief device for an oil pump, including a relief housing constituted by a relief inflow portion, a valve passage portion, a recess, and an oil discharge portion having a relief hole; a relief valve having a small-diameter portion between a first large-diameter portion and a second large-diameter portion; and a spring elastically biasing the relief valve toward the relief inflow portion, wherein the recess is formed at a position that is closer to the relief inflow portion side than to the oil discharge portion, the axial length of the recess is larger than the axial length of the first large-diameter portion of the relief valve, and the shortest axial distance between the recess and the relief hole is less than the axial length of the small-diameter portion.

The aforementioned problems are also resolved by the second aspect of the present invention which is the first aspect, wherein the recess is formed by a main recess that is formed at a front side of the valve passage portion and an auxiliary recess that is formed on an opposite side to the main recess, with the valve passage portion being interposed between the auxiliary recess and the main recess, and the main recess and the auxiliary recess are formed linearly. The aforementioned problems are also resolved by the third aspect of the present invention which is the first or second aspect, wherein the recess is formed as a narrow hole extending in the axial direction. The aforementioned problems are also resolved by the fourth aspect of the present invention which is the first aspect, wherein the widthwise dimension of the recess is less than a diameter of the valve passage portion.

SUMMARY OF THE INVENTION

According to the first aspect of the invention, the oil relief is performed within a range from the low-revolution region to the medium-revolution region of the engine, the relief is stopped within a range from the medium-revolution region to the high-revolution region, and the appropriate oil pressure can be maintained at each revolution speed of the engine. Further, an unstable state in which the oil pressure drops rapidly from the normal state in each revolution region can be prevented. In addition, although the device in accordance with the present invention demonstrates the abovementioned effect, the device can have a very simple configuration, can be easily assembled, and can be provided at a low cost.

According to the second aspect of the invention, the auxiliary recess is formed in addition to the main recess. As a result, the circulation amount of oil in the recess in the low-revolution region to medium-revolution region can be increased. Thus, by increasing or decreasing the volume of the auxiliary recess, it is possible to adjust easily the pressure in the low-revolution region to medium-revolution region. Furthermore, since the main recess and auxiliary recess can be easily formed in a linear shape by using a casting pin, low cost production is realized.

In accordance with the third aspect of the invention, the recess is formed as a narrow hole extending in the axial direction and having a small thickness in the circumferential direction. As a result, oil circulation can be performed in the recess in a revolution region wider than that in the case where the spring strength is adjusted. Since the revolution region in which the oil circulation is performed can be expanded or contracted by changing the axial length of the recess, a very fine pressure control can be performed as desired. In accordance with the fourth aspect of the invention, because of the configuration in which the widthwise dimension of the aforementioned recess is less than the diameter of the aforementioned valve passage portion and the recess is formed as a groove in the circumferential portion in the inner circumferential surface of the valve passage portion, it is possible to set a low amount of relief oil in the relief operation in a range from the low-revolution region to the medium-revolution region and rapid decrease in the oil pressure can be prevented.

BRIEF DESCRIPTION OF THE DRAWINGS

FIG. 2A is a cross-sectional view in which the relief housing, relief valve, and spring in accordance with the present invention are separated from each other; FIG. 2B is an enlarged planar perspective view of portion (III) shown in FIG. 2A; and FIG. 2C is a cross-sectional view along the YI-YI arrow shown in FIG. 2B;

FIG. 10 is a graph for comparing the present invention with the conventional technique.

DESCRIPTION OF THE PREFERRED EMBODIMENTS

Figure 1A:
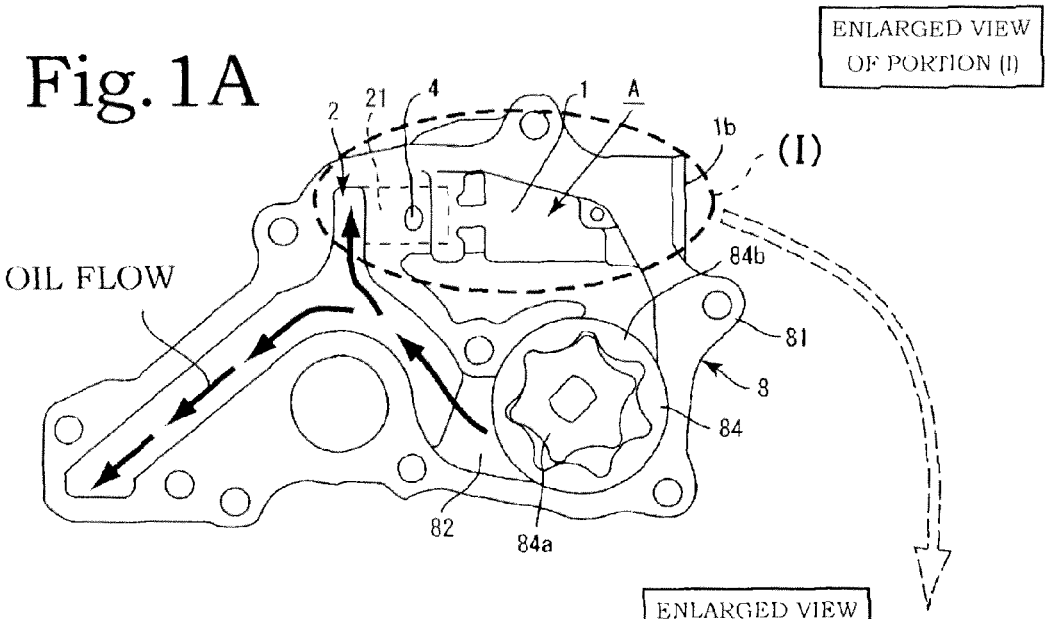
FIG. 1A is a plan view of the oil pump equipped with the relief valve device in accordance with the present invention.

Embodiments of the present invention are described below with reference to the appended drawings. As shown in FIG. 1, the relief device in accordance with the present invention is mainly constituted by a relief housing A, a relief valve 6, and a spring 7. The relief housing A is integrally formed inside a main body portion 81 of a pump body 8 of a mechanically driven oil pump 84 that supplies oil to an engine. The oil pump 84 is of an internal-engagement gear type, more specifically a toroidal gear pump constituted by an inner rotor 84*a* and an outer rotor 84*b*. The oil pump 84 is disposed in an appropriate location inside an engine room.

Figure 1B:
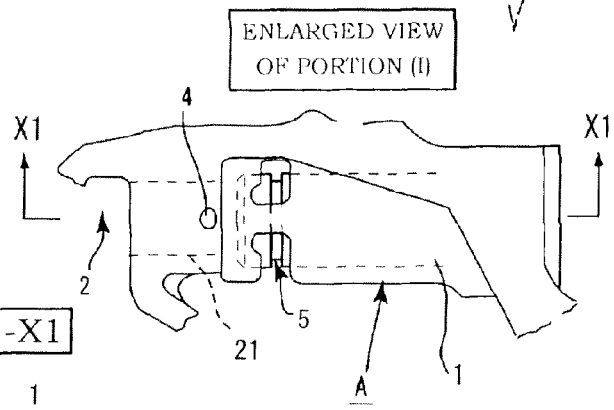
FIG. 1B is an enlarged view of portion (I) shown in FIG. 1A.
Figure 1B:
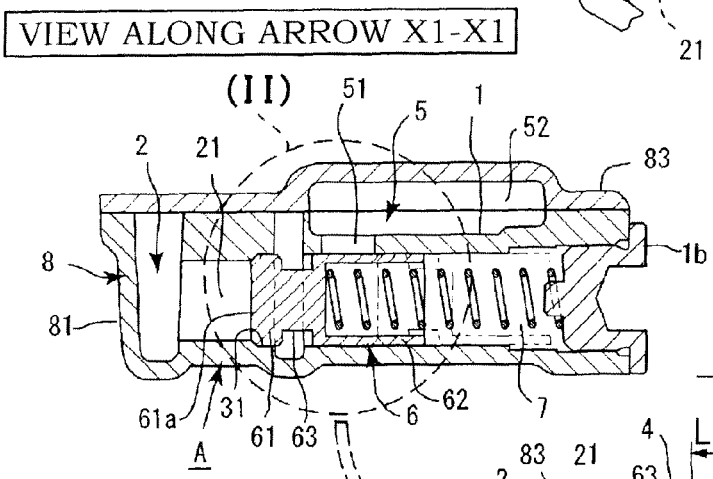

The relief housing A is formed as a tunnel of a substantially hollow cylindrical shape on the downstream side of a discharge flow channel 82 of the oil pump 84 formed inside the pump body 8. The relief housing A is constituted by a cover portion 1, a relief inflow portion 2, and a valve passage portion 3 (FIGS. 1A, 1B, and 2). The cover portion 1 is formed as a housing in a predetermined location of the pump body 8, more specifically as a substantially tunnel-shaped cylindrical expanding portion so that it has inside thereof a substantially tubular passage along the axial direction in the surface at a predetermined location of the pump body 8.

Figure 10:
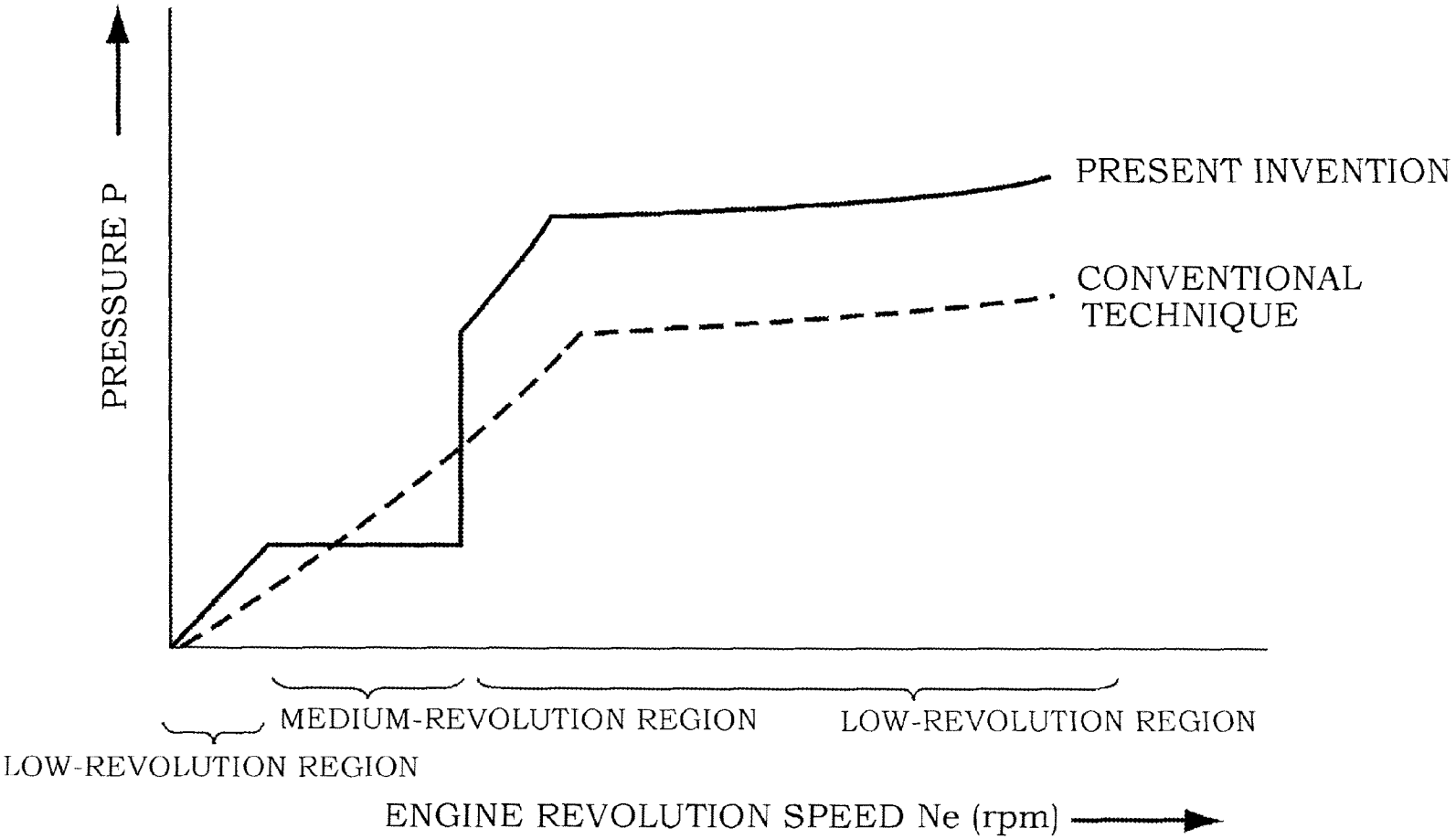
FIG. 10 is a cross-sectional view along the XI-XI arrow shown in FIG. 1B.

The axial direction, as referred to herein, is a longitudinal direction of the passage (valve passage portion 3) inside the relief housing A. This is the direction in which the (below-described) relief valve 6 accommodated in the passage moves reciprocatingly. More specifically, it is the horizontal direction in FIGS. 1B and 10. The relief inflow portion 2 and the valve passage portion 3 are disposed inside the cover portion 1 so as to communicate with each other. The relief inflow portion 2 is positioned on the upstream side and the valve passage portion 3 is positioned on the downstream side inside the cover portion 1.

In other words, the relief inflow portion 2 is positioned closer to the oil pump than the valve passage portion 3, and the oil from the discharge flow channel 82 initially enters from the relief inflow portion 2. The relief inflow portion 2 is communicated with the valve passage portion 3 so as to cross it orthogonally. A relief introducing path 21 is formed in the relief inflow portion 2, and the relief introducing path 21 communicates with the valve passage portion 3 (see FIG. 2A).

The valve passage portion 3 is a passage that is formed as a cylindrical cavity inside the cover portion 1 of the relief housing A. The below-described relief valve 6 and spring 7 are accommodated inside the valve passage portion 3. The valve passage portion 3 is formed continuously and coaxially with the relief introducing path 21 in the axial direction (see FIG. 2A).

The oil that has flown in from the relief inflow portion 2 pumps the relief oil through the relief introducing path 21 toward the valve passage portion 3. The relief introducing path 21 is not a passage for reciprocating movement of the below-described relief valve 6 and therefore, the relief valve 6 neither enters nor exits the relief introducing path 21 (see FIGS. 1C and 1D).

The valve passage portion 3 is a passage in which the relief valve 6 reciprocates and is formed to have a diameter larger than that of the relief introducing path 21. A step surface 31 is formed at the boundary of the valve passage portion 3 and the relief introducing path 21 (see FIGS. 2A and 2B). The step surface 31 acts as a stopper for the movement of the relief valve 6 and restricts the movement range of the relief valve 6 (see FIGS. 1C and 1D).

The step surface 31 is formed as an inner circumferential surface of a truncated conical shape matching the shape of a head portion 61*a* of the below-described relief valve 6 (see FIGS. 2A and 2B), but this shape is not particularly limiting and the step surface may be a flat surface perpendicular to the axial direction. A recess 4 and an oil discharge portion 5 are formed in the valve passage portion 3. The positional relationship of the recess 4 and the oil discharge portion 5 is such that the recess 4 is on the upstream side and the oil discharge portion 5 is on the downstream side. More specifically, the recess 4 is formed on the front side and the oil discharge portion 5 is formed on the rear side, as viewed from the relief introducing portion 2 side.

The recess 4 is a concave portion formed along the inner circumferential surface in the cover portion 1 of the relief housing A. The recess 4 is a part which is initially exposed on the inner circumferential surface of the cover portion 1 and into which the relief oil flows when the relief oil flowing into the valve passage portion 3 pushes and moves the relief valve 6 under the oil pressure P. Furthermore, the recess 4 also serves to transport the relief oil, only when the below-described special condition is satisfied, between itself and the oil discharge portion 5, which is next to be exposed, along the axial direction inside the valve passage portion 3 (see FIG. 5).

Various embodiments of the recess 4 can be used. In the first embodiment, the cross-sectional shape of the recess that is orthogonal to the axial direction of the relief housing A is a linear substantially U-shaped groove (see FIGS. 25 and 2C). In other words, the recess 4 can look like a round hole obtained by removing the material orthogonally to the axial direction so as to obtain a substantially U-like cross-sectional shape along the inner circumferential surface of the cover portion 1.

In the recess 4, the concavity on the cover portion 1 side (front side) is referred to as a main recess 41. A concavity on the side (rear side) opposite that of the main recess 41, the valve passage portion 3 being interposed between the front side and the rear side, is referred to as an auxiliary recess 42. The diameters of the main recess 41 and the auxiliary recess 42 of the recess 4 are less than the inner diameter of the valve passage portion 3. The main recess 41 is formed to have a volume larger than that of the auxiliary recess 42 (see FIG. 2A).

Figure 9B:
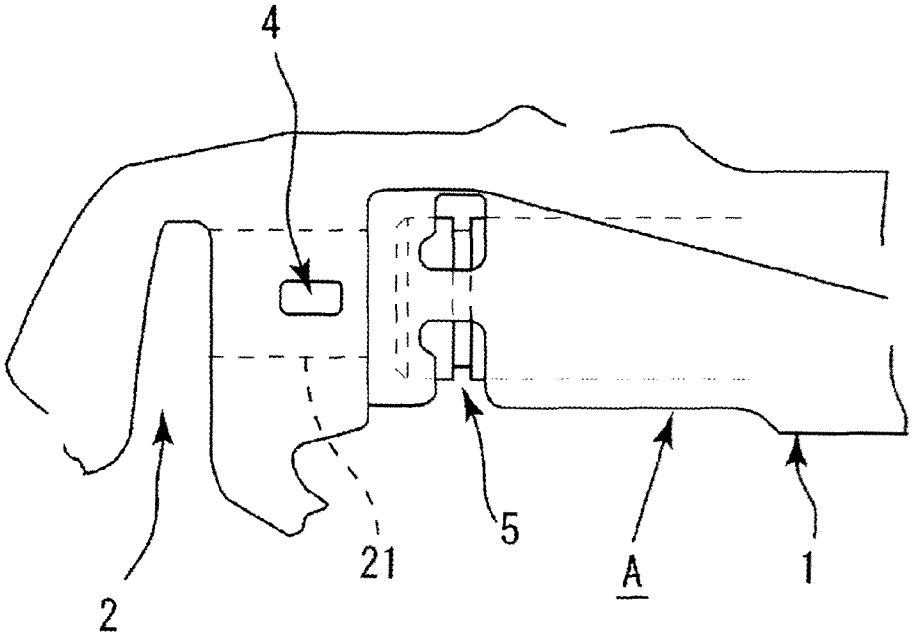
FIG. 9B is a plan view of the relief housing of another embodiment of the present invention.
Figure 9A:
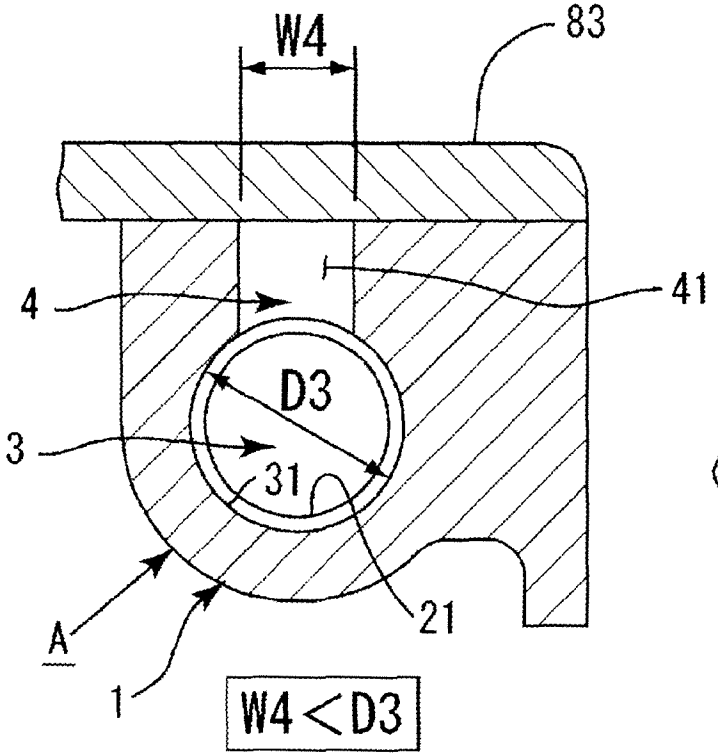
FIG. 9A is a principal cross-sectional view illustrating the second embodiment of the recess.

In the second embodiment of the recess 4, only the main recess 41 is formed in the recess 4, and the auxiliary recess 42 is not formed (see FIG. 9A). In the second embodiment, oil also circulates in the main recess 41 and therefore the effect of the present invention can be fully demonstrated. Where the recess 4 is manufactured by casting, the recess can be formed by using a casting pin, and since the depth of the recess 4 can be easily adjusted by changing the position of the casting pin, cost fluctuations are minimized.

In the third embodiment of the recess 4, the recess 4 is formed as a fine long hole that is long in the axial direction and narrow in the circumferential direction, rather than the round hole (see FIG. 9B). Similarly to the recesses of the first and second embodiment, the recess 4 of the third embodiment has a draft and therefore is a hole of the substantially same shape from the front surface to the rear portion, rather than of the entirely identical shape. By configuring the recess 4 as a fine long hole that is long in the axial direction, the rotation region where the oil circulates in the recess 4 can be expanded by comparison with that of the round hole. In other words, by adjusting the axial length of the recess 4, it is possible to adjust the pressure easier than in the case where only the strength of the spring 7 is adjusted.

Figure 1D:
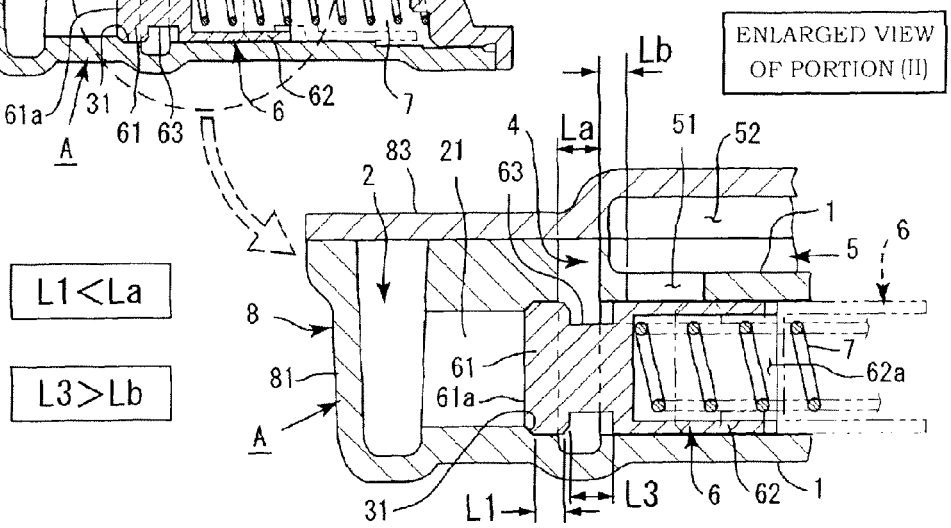
FIG. 1D is an enlarged view of portion (II) shown in FIG. 1C.

Further, the oil discharge portion 5 is constituted by a relief hole 51 and a discharge flow channel 52 (see FIGS. 1C, 1D, and 2). The relief hole 51 passes through the wall of the cover portion 1 of the relief housing A and is formed such that the inner circumferential surface and outer circumferential surface of the cover portion 1 can communicate therethrough. The discharge flow channel 52 communicates with the interior and exterior of the cover portion 1 via the relief hole 51 and serves to return the relief oil discharged from the oil discharge portion 5 to the intake side of the oil pump 84.

The relief housing A, including the pump body 8, is formed by casting, and therefore one surface of the main body portion 81 of the pump body 8 is an open surface. A cover material 83 for covering the open portion is provided as a member constituting the pump body 8, and the discharge flow channel 82 or the pump chamber of the oil pump 84 is configured by mounting the cover material 83 so as to cover the open surface of the main body portion 81.

The recess 4 is configured as a groove-shaped cavity enclosed on the circumference by the cover material 83. The part of the recess 4 that is close to the cover material 83 side serves as the main recess 41, and the round part n the opposite side serves as the auxiliary recess 42 (see FIGS. 2B and 2C). The oil discharge portion 5 of the discharge flow channel 52 is formed by mounting the cover material 83 on the relief housing A (see FIGS. 2B and 2D).

More specifically, the circumference where the relief hole 51 is formed on the outer circumferential surface of the cover portion 1 is formed to recede slightly as a thin portion. This receding portion constitutes part of the discharge flow channel 52, a cavity is formed in the circumference of the location of the relief hole 51 on the outer circumferential surface of the cover portion 1 by mounting the cover material 83, and this cavity is used as the discharge flow channel 52 (see FIGS. 2B and 2D). Further, a sealing bolt lb is attached as a closing member to the end portion on the side opposite that communicating with the relief inflow portion 2 of the cover material 1 of the relief housing A.

Further, the relief valve 6 is formed in a cylindrical shape and constituted by a first large-diameter portion 61, a second large-diameter portion 62, and a small-diameter portion 63.

The small-diameter portion 63 is formed between the first large-diameter portion 61 and the second large-diameter portion 62 (see FIGS. 1C, 1C, and 2A). The first large-diameter portion 61 and the second large-diameter portion 62 have the same or substantially the same diameter (see FIG. 2A). The first large-diameter portion 61 has a cylindrical shape, as described hereinbelow, more specifically a flat cylindrical shape, and the outer peripheral edge of the head portion 61*a* which is the tip thereof is formed by machining into an inclined shape to obtain a truncated conical shape with a gradually reducing diameter. The outer peripheral edge on the side opposite that of the head portion 61*a* of the first large-diameter portion 61 is also chamfered into an inclined shape (see FIGS. 1D and 2A).

The second large-diameter portion 62 is formed to be longer in the axial direction than the first large-diameter portion 61. A cavity 62*a* of a hollow cylindrical shape is formed inside the second large-diameter portion 62, and the axial end portions of the cavity are open. Part of the below-described spring 7 is inserted into the cavity 62*a* (see FIG. 1C). The first large-diameter portion 61 and the small-diameter portion 63 are formed in a solid cylindrical shape.

The small-diameter portion 63 is formed to have a diameter somewhat less than that of the first large-diameter portion 61 and the second large-diameter portion 62, and the formation location of the small-diameter portion 63 in the relief valve 6 can be seen as a groove formed along the circumferential direction. Further, the relief valve 6 is formed to have an outer diameter slightly less than the inner diameter of the valve passage portion 3, so that the relief valve could smoothly move in the axial direction inside the valve passage portion 3. The two are fit together by clearance fitting of a comparatively high accuracy.

The relationship between the configuration of the recess 4 and the oil discharge portion 5 in the relief housing A and the configuration of the relief valve 6 will be explained below. The axial length dimension L1 of the cylindrical portion of the maximum diameter in the first large-diameter portion 61 of the relief valve 6 is less than the axial length dimension La of the recess 4, that is, L1<La (see FIGS. 1D, 2A, 3B, and 5B).

The axial length dimension L1 of the cylindrical portion of the maximum diameter in the first large-diameter portion 61 of the relief valve 6 as referred to herein is the size of the cylindrical portion from which the abovementioned head portion 61*a* and the chamfered portion of the inclined shape that has been formed on the circumferential edge on the side opposite that of the head portion 61*a* in the axial direction have been excluded (see FIGS. 1D and 2A).

The axial dimension L3 of the small-diameter portion 63 is larger than the shortest distance Lb between the recess 4 and the relief hole 51 of the oil discharge portion 5, that is, L3>Lb (see FIGS. 1D, 2A, 3B, and 5B). In this case, the shortest distance Lb between the recess 4 and the relief hole 51 of the oil discharge portion 5 as referred to herein is the axial distance between the portion of the circumferential edge of the relief hole 51 that is the closest to the recess 4 as viewed from the recess 4 side and the portion of the edge of the recess 4 that is the closest to the relief hole 51, as viewed from the relief hole 51 (see FIGS. 1D, 2A, 3B, and 5B).

With the configuration in accordance with the present invention, the relief operation is generally performed as described hereinbelow. First, part of the oil flowing from the upstream side to the downstream side of the discharge flow channel 82 of the oil pump 84 flows as relief oil from the relief inflow portion 2 and the relief introducing path 21 of the relief valve device into the valve passage portion 3 (see FIGS. 1A and 3). Where the pressure P of the relief oil then rises, the relief valve 6 starts moving in the direction toward the side opposite that of the relief inflow portion 2 in the valve passage portion 3 against the elastic force of the spring 7 (see FIG. 4). The pressure P in this case is a distributed load (see FIGS. 3 to 8).

Where the pressure P exceeds a specific value, the relief valve 6 continues moving and the recess 4 closed by the first large-diameter portion 61 is opened. When the first large-diameter portion 61 reaches a substantially intermediate position, in the axial direction, of the recess 4, since the axial length dimension L1 of the first large-diameter portion 61 is less than the axial length dimension La of the recess 4 (L1<La), the circulation of the relief oil becomes possible between the recess 4 and the head portion 61*a* of the first large-diameter portion 61 and the small-diameter portion 63.

Further, since the axial length dimension L3 of the small-diameter portion 63 is greater than the shortest distance Lb between the recess 4 and the relief hole 51 of the oil discharge portion 5 (L3>Lb), the circulation path of the relief oil is configured by the recess 4 and the oil discharge portion 5 of the relief housing A and by the small-diameter portion 63 of the relief valve 6. As a result, the relief oil flows from the recess 4 toward the oil discharge portion 5 and the relief operation is performed (see FIG. 5).

Here, the pressure P of the relief oil further rises, the first large-diameter portion 61 closes the gap between the recess 4 and the oil discharge portion 5, and the discharge of the relief oil is stopped. Further increase in the pressure P of the relief oil causes the first large-diameter portion 61 to open the oil discharge portion 5, thereby enabling the direct discharge of the relief oil.

Figure 3A:
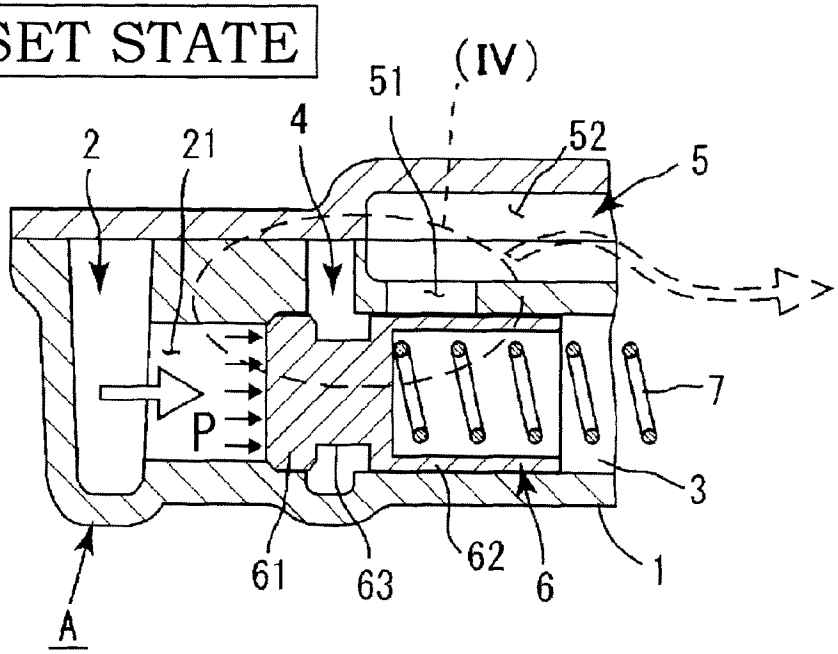
FIG. 3A is a principal cross-sectional view illustrating the operation of the relief valve in a set state in accordance with the present invention.
Figure 3B:
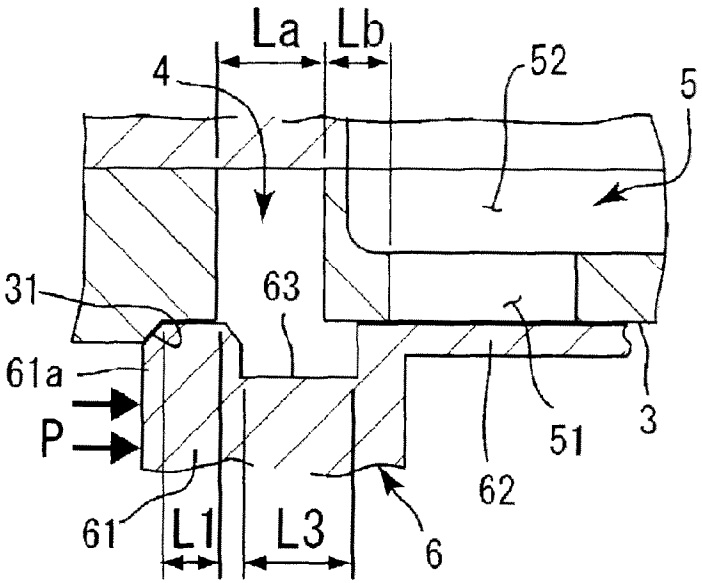
FIG. 3B is an enlarged view of portion (IV) shown in FIG. 3A.

The control state in each of the low-, medium-, and high-revolution regions of the engine will be descried below. Since specific revolution speeds in the low-, medium-, and high-revolution regions differ depending on the engine or pump, the specific numerical values thereof are not presented herein. In a set state, as shown in FIG. 3, the relief valve 6 is entirely pressed against the relief inflow portion 2 by the elastic biasing force of the spring 7. In this state, the oil pump is started. The relief of the relief oil is stopped.

Figure 4B:
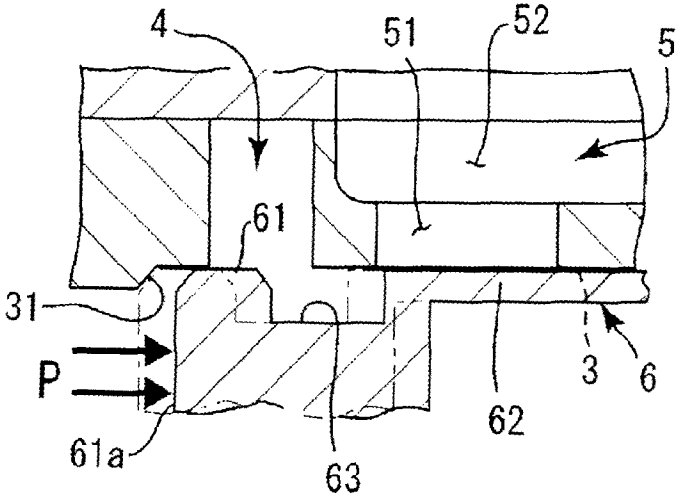
FIG. 4B is an enlarged view of portion (V) shown in FIG. 4A.
Figure 4A:
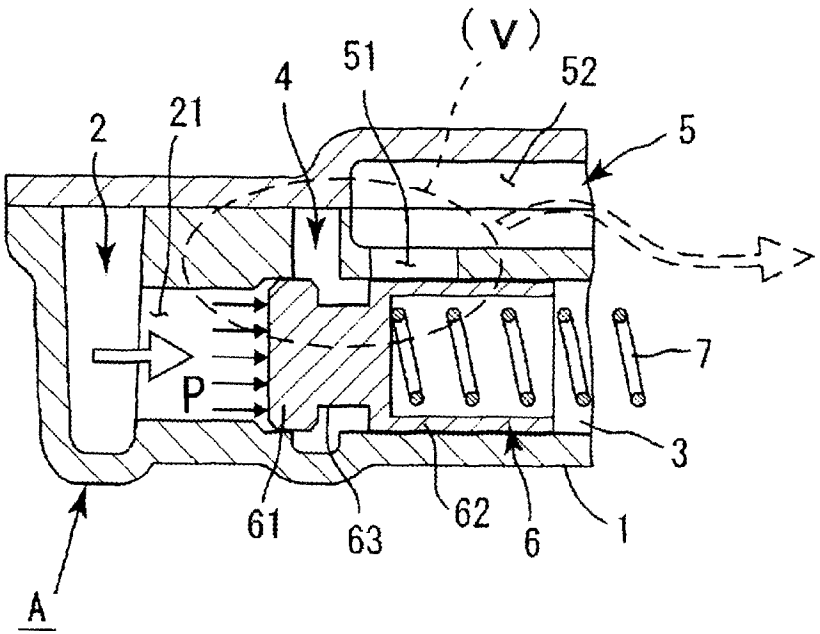
FIG. 4A is a principal cross-sectional view illustrating the operation of the relief valve in a low-revolution region in accordance with the present invention.

In the low-revolution region, as shown in FIG. 4, because the revolution speed is low, the discharge pressure of the oil pump 84 is low and the elastic biasing force of the spring 7 is higher than the force created by the discharge pressure. Therefore, the relief valve 6 practically does not move or only slightly moves. In the valve passage portion 3, the oil discharge portion 5 is entirely closed by the first large-diameter portion 61 of the relief valve 6. Therefore, the oil discharged from the oil pump 84 is entirely discharged without flowing into the recess 4 and oil discharge portion 5. As a result, the oil pressure and flow rate in the low-revolution region can be ensured.

Figure 5B:
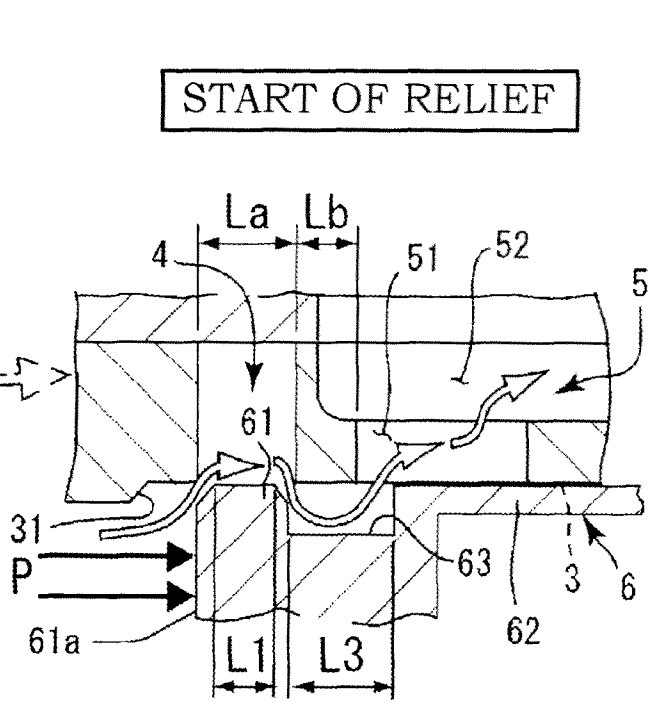
FIG. 5B is an enlarged view of portion (VI) shown in FIG. 5A.
Figure 5A:
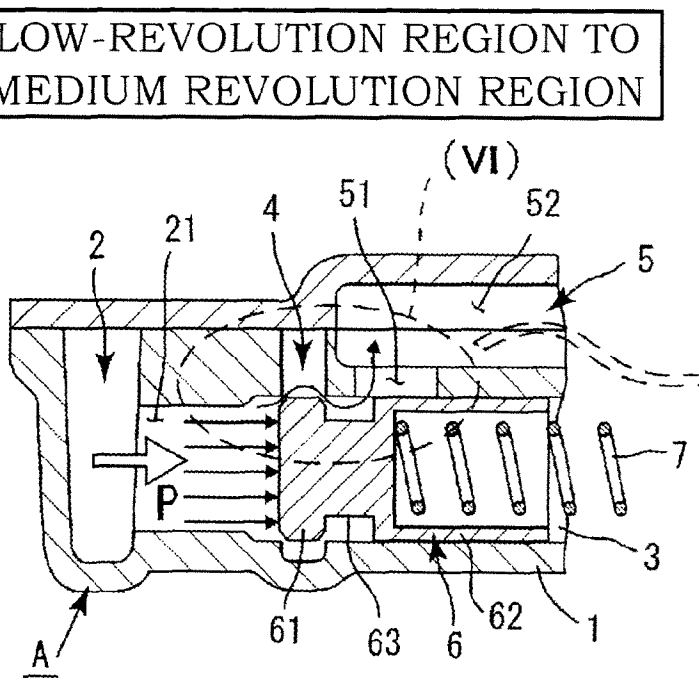
FIG. 5A is a principal cross-sectional view illustrating the operation of the relief valve in a range from a low-revolution region to a medium-revolution region in accordance with the present invention.

In the low-revolution region to medium-revolution region, the pressure P of the relief oil gradually rises, as shown in FIG. 5. Where the pressure P of the relief oil reaches a specific value, the relief valve 6 is moved against the elastic biasing force created by the spring 7 in the direction opposite that toward the relief inflow portion 2 in the valve passage portion 3.

Where the head portion 61*a* of the first large-diameter portion 61 of the relief valve 6 assumes a position in the intermediate location in the axial direction of the recess 4, a circulation path is configured between small-diameter portion 63 of the relief valve 6, on one side, and the recess 4 and the oil discharge portion 5 of the relief housing A, on the other side, the relief oil is discharged from the oil discharge portion 5, and the relief operation is performed (see FIG. 5B). As a result, the pressure P of the relief oil is reduced, thereby preventing the ineffective operation of the oil pump 84 in the low-revolution region to medium-revolution region.

Figure 6A:
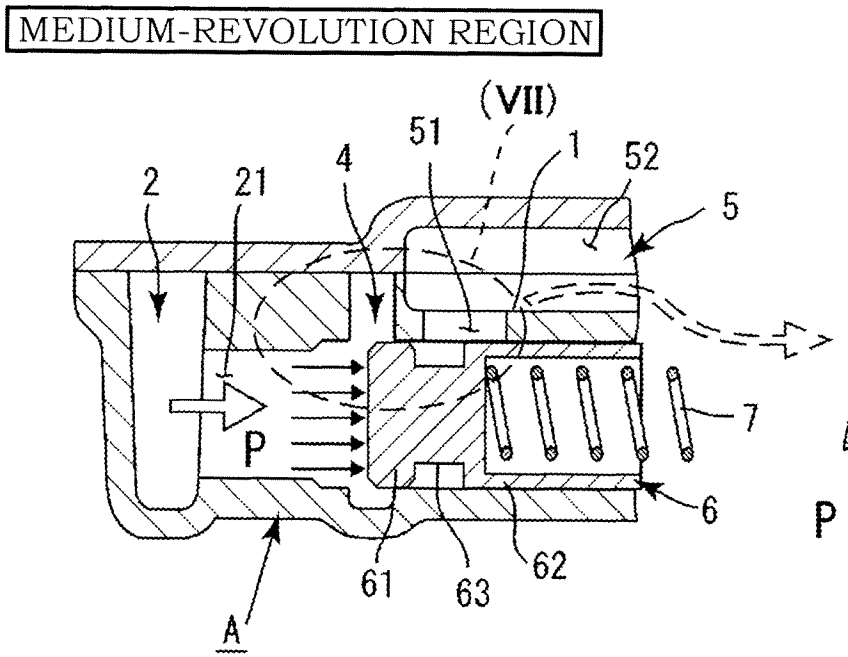
FIG. 6A is a principal cross-sectional view illustrating the operation of the relief valve in the medium-revolution region in accordance with the present invention.
Figure 6B:
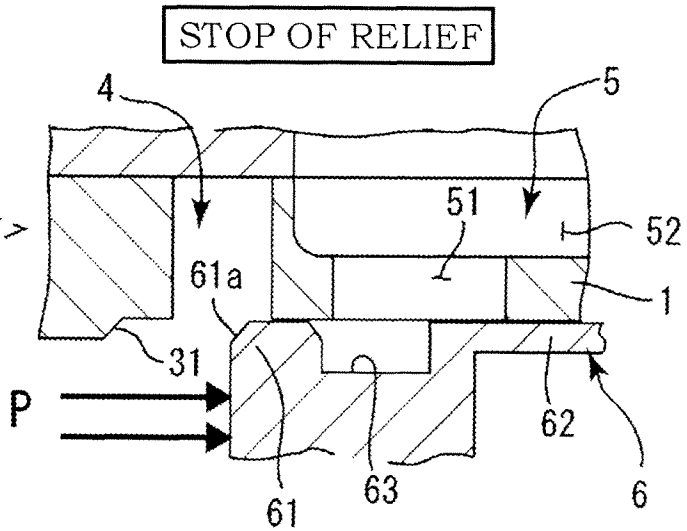
FIG. 6B is an enlarged view of portion (VII) shown in FIG. 6A.

Then, in the medium-revolution region, as shown in FIG. 6, the pressure P of the relief oil further increases and therefore the relief valve 6 further moves and the first large-diameter portion 61 assumes a position between the recess 4 and the oil discharge portion 5. In this state, the movement of the relief oil between the recess 4 and the oil discharge portion 5 in the axial direction inside the valve passage portion 3 is blocked by the first large-diameter portion 61. Therefore, the relief oil is filled up only in the recess 4 and does not reach the oil discharge portion 5, and because the relief hole 51 of the oil discharge portion 5 is not open, the relief is stopped.

Figure 7A:
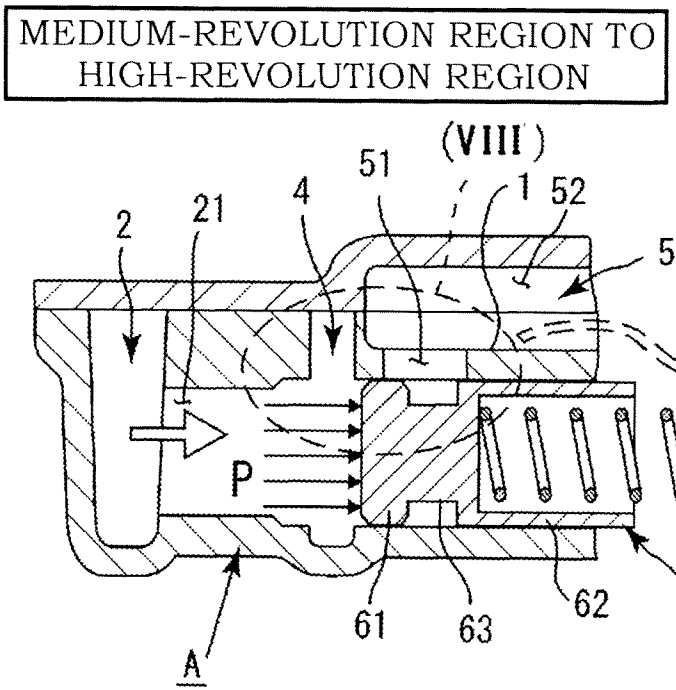
FIG. 7A is a principal cross-sectional view illustrating the operation of the relief valve in a range from the medium-revolution region to a high-revolution region in accordance with the present invention.
Figure 7B:
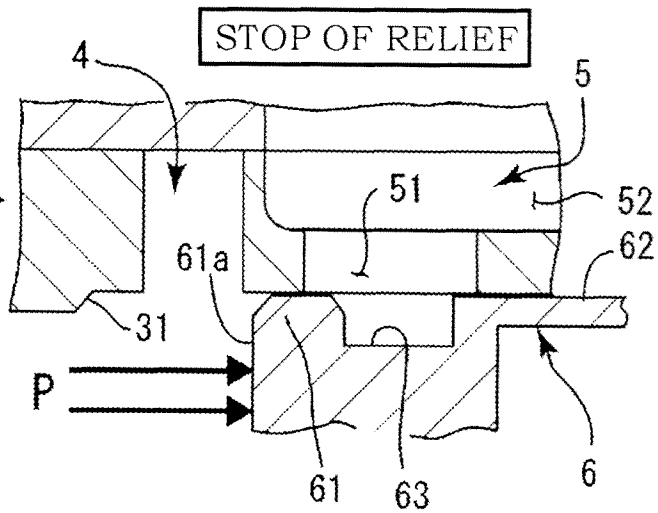
FIG. 7B is an enlarged view of portion (VIII) shown in FIG. 7A.

As a result, the oil pressure rises and lubrication of sliding parts, such as the engine, in the target revolution region can be ensured. In the medium-revolution region to high-revolution region, the operations are substantially like those in the medium-revolution region, but since the pressure P of the relief oil continues rising, as shown in FIG. 7, the relief valve 6 continues moving. However, the relief is in the stopped state.

Figure 8A:
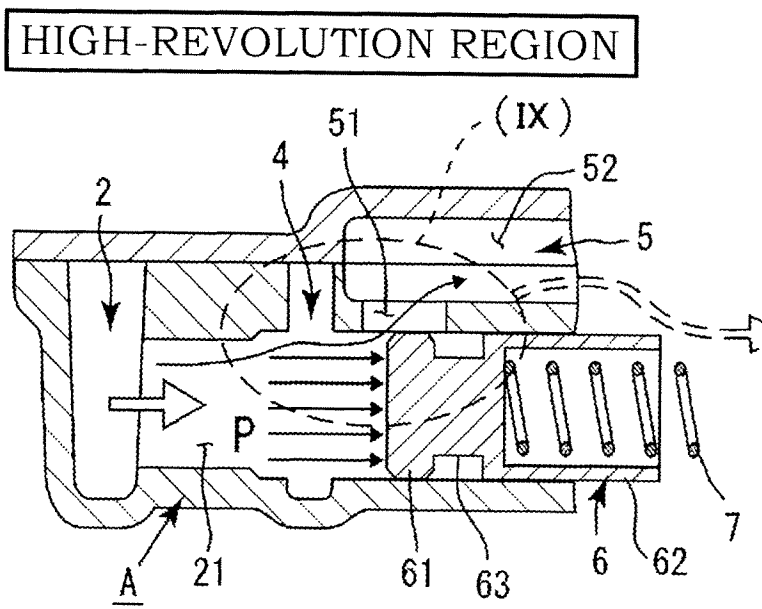
FIG. 8A is a principal cross-sectional view illustrating the operation of the relief valve in the high-revolution region in accordance with the present invention.
Figure 8B:
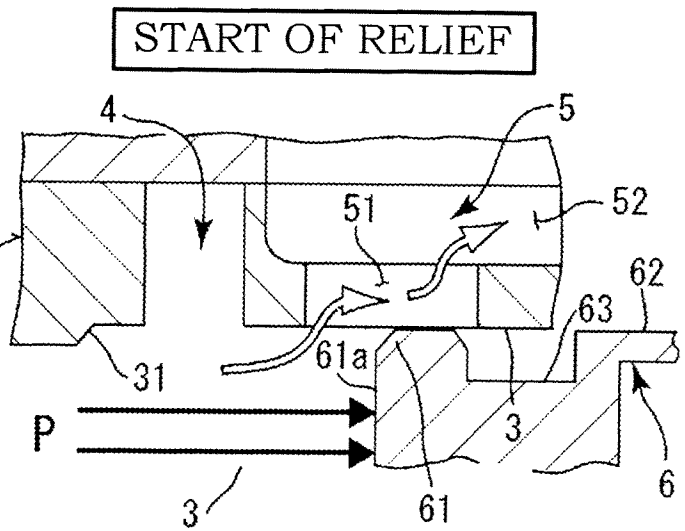
FIG. 8B is an enlarged view of portion (IX) shown in FIG. 8A.

Further, in the high-revolution region, as shown in FIG. 8, the pressure P of the relief oil further rises, the relief valve 6 further moves inside the valve passage portion 3, the first large-diameter portion 61 opens the relief hole 51 of the oil discharge portion 5 inside the valve passage portion 3, and the relief oil can be directly discharged from the oil discharge portion 5. This is a typical discharge process. As a result, the pressure of the relief oil is prevented from rising abnormally. Even when the high-revolution region is exceeded, a typical discharge process in which the relief oil is discharged from the oil discharge portion 5 is likewise performed and the abnormal increase in oil pressure is prevented.

Thus, in accordance with the present invention, in the low-revolution region to medium-revolution region, the relief oil is discharged from the oil discharge portion 5 in the process in which the pressure of the relief oil rises. However, the discharge period is very small and, therefore, the amount of discharged relief oil is also very small. As a result, the oil pressure does not decrease unexpectedly in the low-revolution region to medium-revolution region and stable oil pressure can be maintained. Furthermore, when the pressure P of the relief oil further rises, the first large-diameter portion 61 of the relief valve 6 opens the oil discharge portion 5, and the configuration is changed into a typical discharge means for directly discharging the relief oil from the oil discharge portion 5.

What is claimed is:

1. A relief device for an oil pump, the device comprising a relief housing constituted by a relief inflow portion, a valve passage portion, a recess, and an oil discharge portion having a relief hole; a relief valve having a small-diameter portion between a first large-diameter portion and a second large-diameter portion; and a spring elastically biasing the relief valve toward the relief inflow portion, wherein the recess is formed at a position that is closer to the relief inflow portion side than to the oil discharge portion, an axial length of the recess is larger than an axial length of the first large-diameter portion of the relief valve, and the shortest axial distance between the recess and the relief hole is less than the axial length of the small-diameter portion.

2. The relief device for an oil pump according to claim 1, wherein the recess is formed by a main recess that is formed at a front side of the valve passage portion and an auxiliary recess that is formed on an opposite side to the main recess, with the valve passage portion being interposed between the auxiliary recess and the main recess, and the main recess and the auxiliary recess are formed linearly.

3. The relief device for an oil pump according to claim 1, wherein the recess is formed as a narrow hole extending in the axial direction.

4. The relief device for an oil pump according to claim 1, wherein the widthwise dimension of the recess is less than a diameter of the valve passage portion.

5. The relief device for an oil pump according to claim 2, wherein the recess is formed as a narrow hole extending in the axial direction.

* * * * *